United States Patent [19]

Hebert

[11] Patent Number: 4,549,837

[45] Date of Patent: Oct. 29, 1985

[54] PENSTOCK

[76] Inventor: Camile J. Hebert, P.O. Box 27, Palmetto, La. 71358

[21] Appl. No.: 516,210

[22] Filed: Jul. 21, 1983

[51] Int. Cl.[4] ..... E02B 7/36; E02B 7/40

[52] U.S. Cl. ..... 405/101; 405/89; 405/100; 405/106

[58] Field of Search ..... 405/77, 80, 87–89, 405/92, 99–102, 106–108

[56] References Cited

U.S. PATENT DOCUMENTS

| | | | |
|---|---|---|---|
| 1,059,834 | 4/1913 | Cheatham | 405/89 |
| 1,138,762 | 5/1915 | Kiesau | 405/106 |
| 1,161,997 | 11/1915 | Thompson | 405/106 |
| 2,694,292 | 11/1954 | Wing | 405/106 X |
| 2,725,720 | 12/1955 | Lough | 405/102 |
| 2,759,697 | 8/1956 | Harza | 405/100 X |
| 3,333,423 | 8/1967 | Cook | 405/100 |
| 4,324,506 | 4/1982 | Steinke | 405/101 X |
| 4,332,506 | 6/1982 | Andrews | 405/101 X |

FOREIGN PATENT DOCUMENTS

| | | | |
|---|---|---|---|
| 715698 | 2/1980 | U.S.S.R. | 405/80 |

*Primary Examiner*—Dennis L. Taylor

*Assistant Examiner*—Nancy J. Stodola

*Attorney, Agent, or Firm*—Keaty & Keaty

[57] ABSTRACT

An improved penstock for water-flow control provides the capability of establishing a constant water level within a levee or a dike and is continuously adjustable between a high and a low water level. The penstock has an erosion-resistant flow channel which is embedded and buried in an earthen levee dike or dam which has leakage prevention and seepage prevention protrusions extending around its outer periphery. In the throat of the flow channel is a pivoted, sealed level-control gate which can be adjusted and latched at any position from a horizontally flat position, permitting unrestricted flow through the channel, to a vertical position, blocking off flow through the channel. This pivoting gate is provided with edge seals to prevent the leakage of water. Once adjusted, the gate will maintain a constant water depth within the body of water enclosed by the levee while passing overflow over the gate. The penstock can be made either of metal or of a suitable plastic and can be either permanently embedded in the levee or can be dug out and removed if a levee is replaced as is typical in rice fields and the like.

5 Claims, 7 Drawing Figures

PENSTOCK

BACKGROUND OF THE INVENTION

This invention is a fluid depth regulator or penstock which will provide improved, easier control of water and fluid levels in rice fields, oil well run off pits or any other application where fluids need to be maintained at a pre-determined level, raised or lowered, between two or more liquid holding areas.

This penstock can be used to control the water level held by dikes, small levees and similar structures. It greatly improves present methods of fluid level control by reducting manhours, energy expenditure and replacement costs. More importantly, the risk of catastropic fluid loss is eliminated by the unique method involved in blocking and passing the flow of water within the throat of the penstock mechanism, together with the seepage prevention techniques employed.

Specifically, within the area of rice field culture, the cultivating of rice requires a capability for, during the growth cycle of the rice, flooding a rice field to a controllable depth, raising and lowering the water levels periodically within the rice field, and draining the rice field to a very low level. In addition, it is common in the rice fields of Southern Louisiana to raise crayfish as a second crop within a rice field. Crayfish cultivation requires additional water level controls during the growth and harvesting cycles of the crayfish, and normally requires considerably deeper water than the cultivation of rice.

Prior art methods of maintaining and establishing water levels within a system of levees or dikes for rice production and crayfish production are both time consuming and costly. In one case, the method consists of cutting a gap within a levee, installing a plastic apron within that gap and covering the sides of the apron with dirt to prevent seepage or washing out of the cut. In order to raise the depth of water in the rice paddy, the plastic apron must be raised and dirt or some object placed underneath. Lowering the water depths would require removing the dirt beneath the plastic apron and deepening the the gap. This procedure of adjusting the depth often requires the work of two men at a time. The life expectancy of the plastic apron is only one to two years, depending on the type of material used in making it.

An alternate method of control is to cut an opening in a levee with a shovel allowing the water to flow through freely, and then closing the gap in the levee by filling in the hole. This method is a cheaper expedient in comparison to using the classic sliding gate penstocks that have been shown in the prior art.

Water control through these penstocks is established by raising and lowering a sliding gate. It is obvious that if the gate is raised, water is flowing through the bottom of the penstock, and unless the gate is shut, the field being drained will be drained completely dry. A constant water level cannot be maintained by this method. As a result, rice farmers have habitually used the levee-cut method, which has the advantage that if the cut is left open and erosion is restrained, water level only goes down to the level of the cut made in the levee. Therefore, an accident or jamming of the flow control means will not result in a drying out of the rice field.

A final method in common use in rice fields is the installation of flexible plastic pipe through a levee with a three- or four-foot flexible end extending into the lower of the two paddies. A post with block and tackle or similar mechanism is then used to enable a man to raise and lower the lower end. As will be obvious, this pipe then works as an inverted siphon and establishes a fluid level based on the height to which the long end has been raised. Again, this is in the nature of a temporary field expedient. The piping mechanism has a lifetime of from one to two years in actual use, and, of course, the mechanism must be constantly monitored as a break in the rope or a failure in the mechanism will result again in a complete draining of the upper field.

Similar requirements for maintaining a constant level of water in a pool or pond or for separating and establishing the flow off of an upper layer of a liquid while resisting the flow or drainage of a lower layer of liquid are encountered in oil well pits where oil and water must be separated, or in similar separation ponds encountered in environmental control applications or in chemical factories. Again, the liquid control means requires that a cut to a certain depth or an opening to a certain depth be made in the levy or wall forming the pond. Liquid above this depth then flows off into a second pond or second area. Liquid below that depth is maintained in the first pond.

SUMMARY OF THE INVENTION

My invention is a fluid depth regulator to provide better and easier control of depth of water or other fluids within ponds, levied liquid holding areas, rice fields, oil well run-out pits, and the like. This invention greatly improves present methods of fluid level control by reducing manhours, energy expended and replacement costs.

This depth regulator consists of a control plate which is continuously adjustable from an essentially flat position along the bottom of the throat of a provided flow channel to an essentially vertical position blocking all liquid flow through the channel.

The flow channel itself, is a provided aparatus similar to that currently in use for sliding gate penstocks with certain advantages that I will hereinafter disclose.

This flow channel takes the form of an essentially flat bottomed U-shaped fluid impervious material which in my invention, may either be metal or preferably one of the structural plastics. This channel is embedded in the wall of an earthen levee or dike and provides an erosion-free flow path for fluids, protecting the levee or dike from undercutting seepage and erosion as will be described.

On my improved flow channel, I provide a set of angled throat entrances and exits to channel the flow of the water and also to provide a resistance from the force of the water pushing through or seeping around the outside of the flow channel as it is buried or embedded in the earthen wall of the levee. More importantly, however, I provide, extending to a distance somewhat significantly outside the widest opening of the angled throat of my flow channel, a continuous impervious seepage prevention plate, perpendicular to the direction of flow through the flow channel, extending both downward and outward to the sides of the flow channel.

When the flow channel is buried properly in the earthen side of a levee, this seepage prevention plate extends significantly beyond the outer dimensions of the channel when the earth is properly packed around the sides and bottom of the flow channel, which should be buried so that the top is flush with the top of the levee in which it is embedded. This plate provides a significant barrier to seepage of water and essentially prevents any erosion around the outside of the channel, thus preventing washout which would defeat the purposes of having the flow control mechanism.

The flow channel as designed, has an essentially flat bottom. Along this bottom is placed a pivoting hinge mechanism supporting a pivoting plate, which when raised to a vertical position, essentially blocks the entire throat of the flow channel. This plate, when lowered, lies flat along the bottom of the flow channel and provides essentially no restriction to flow. An extruded rubber seal having one end enclosed and firmly held within the edge of the plate, and running the length of each side of the plate, sweeps along the throat of the channel and provides a blockage to any seepage of liquid. Thus, the only path for liquid flow through the flow channel, when the plate is raised to an intermediate position between its lowest and its most vertically extreme position, is over the edge of the flow channel restrictor plate. This provides a depth regulator means which establishes a liquid level behind the levee which is maintained as a constant depth depending on the adjustment of the angle of the plate.

The plate is held in position by an opposing pair of latches mounted on the upper end of the movable end of the regulator plate, outwardly engaging with a mating provision provided in a swept arc on the two side walls of the flow channel. This mating latch and engaging arc can be adapted to the particular materials from which the overall aparatus is constructed. For example, with a metal flow channel and regulator plate, a standard dead bolt with a mating sequence of interlocking lugs or indentations appears to provide the best results. With a structural plastic flow channel and regulator plate, I have found that a modified, springloaded dead bolt having a serated edge engaging with a regularly provided series of serations along the swept arc on the sides of the flow channel, provides the best result.

It is a particular object of this invention to provide an improved fluid control or flow control device to installing in a levee or dike or the like, for maintaining a constant liquid level within a pond or a pool.

It is a further object of this invention to provide a liquid level control device which may permanently embedded in an otherwise, earthwork dam, dike, or levee to provide a constant controllable liquid level.

It is a further object of this invention to provide a penstock which can left unattended in a levee wall to maintain a pre-determinable liquid depth.

It is a further object of this invention to provide a penstock which may be adjustable to one of many continuously variable positions for maintaining an adjustable water depth.

It is a further object of this invention to provide a penstock or fluid control channel through an earthwork levee which is substantially immune to seepage, leakage and erosion.

It is a further object of this invention to provide a fluid control penstock which can be repeatedly reset during a growing cycle to provide varying pond depths for a series of aquaculture or mixed aquaculture growing cycles during a year.

DESCRIPTION OF THE DRAWINGS

FIG. 2 is an upper perspective view of the penstock as installed in a levee or the like.

DETAILED DESCRIPTION OF THE PREFERRED EMBODIMENT

Figure 2:
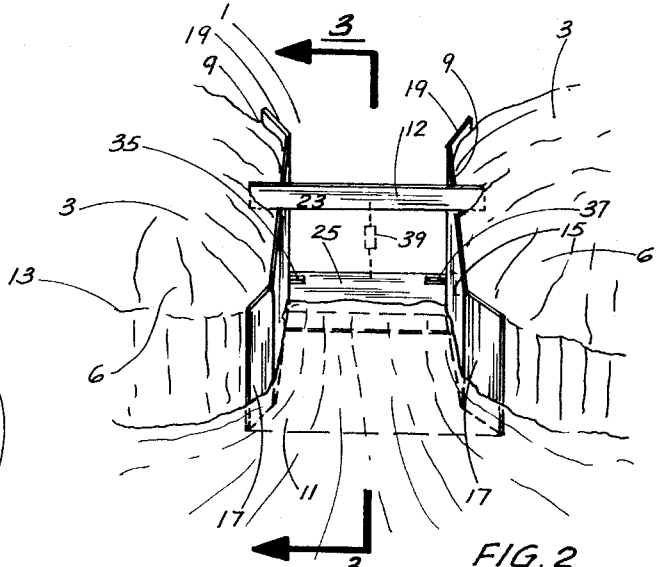
Figure 3:
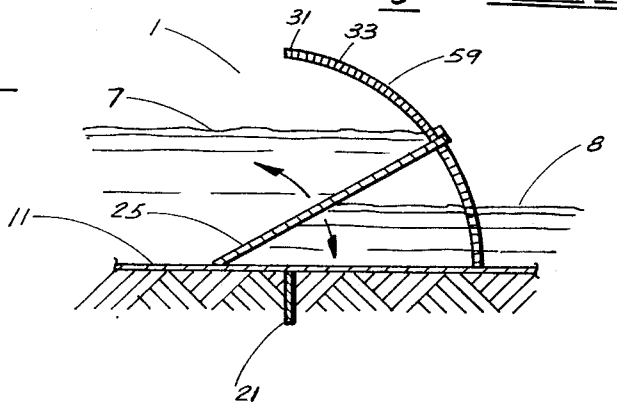
FIG. 3 is a cross-section view of the improved penstock as installed in FIG. 2 showing the differential level of liquid or water maintained by the flow control plate.
Figure 7:
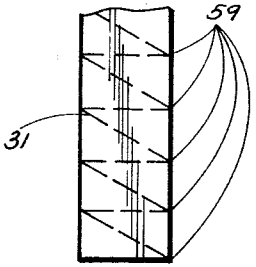
FIG. 7 is a side view of the side locking arch teeth.
Figure 6:
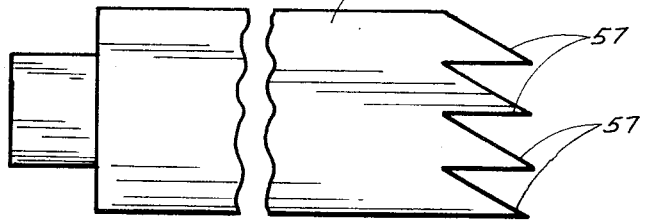
FIG. 6 is a detailed sectional view of one of the side locking bolts particularly showing the side locking bolt teeth.
Figure 1:
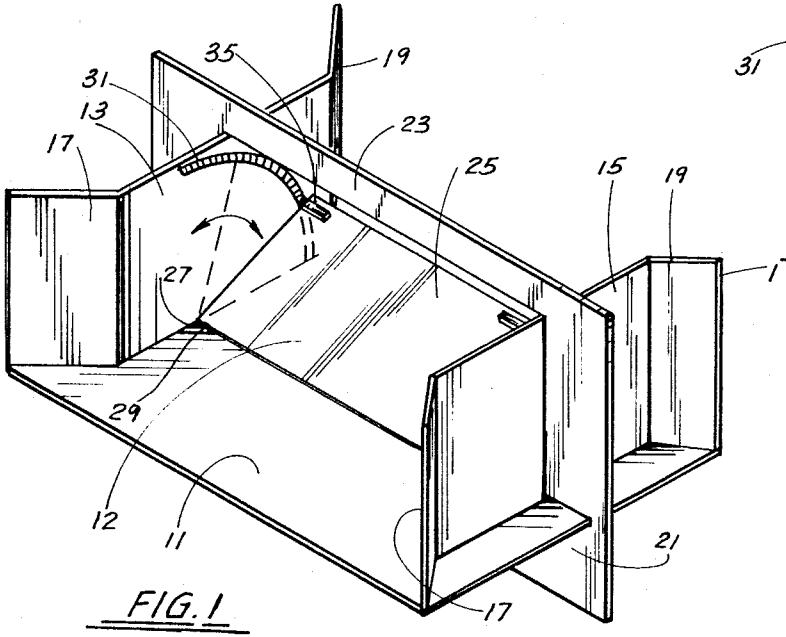
FIG. 1 is an angle perspective view of the improved Penstock showing the installation of the depth regulator or flow control plate.

Referring to FIG. 2 and FIG. 3, I show an improved penstock FIG. 1 as installed typically in a levee 3. A levee as is known to those skilled in the art is a field earthwork construction, comprising essentially a series of levee walls 6 made of piled earth, clay or other impervious natural materials, which is used to separate two bodies of water or ponds having an upper pond level 7 and a lower pond level 8. As is well known such levees are used for such purposes as creating rice fields or for the raising of aquatic or marine organisms in agricultural pursuits, as well as for any application in which water is required to be retained in ponds either at a controlled level or at a controlled flow. Such applications include but are not restricted to chemical holding pools, waste liquid pits, and various large quantity liquid treatment facilities such as ponds for separating liquids of different densities or different contents.

Communication in flow from within a levee to without a levee or between an upper pond level 7 and a lower pond level 8 requires that a cut 7 be placed in the wall of a levee to provide fluid communication between the two pond levels.

As shown in FIG. 2 and in FIG. 3, my improved penstock 1 is inserted within this levy cut and is used to control the flow of the liquids therethrough as is more particularly shown below:

To preserve the liquid holding integrety of the levee, seepage prevention means are provided to restrict the flow of fluid to within the flow channel, and to prevent erosion, washout, and ultimately failure of the levee at the penstock location.

These seepage and flow erosion control means are provided essentially as follows. First I provide inlet side seepage restriction flare 17 by angling each of the side flow channels 13, 15 outward at substantially a thirty degree angle for a distance of approximately twenty percent of the length of the overall flow channel 12. This seepage restriction flare is welded at the bottom to the base plate 11 so as to provide a continuous flow restriction. Likewise I provide an outlet side seepage restriction flare 19 by flaring the left and right side flow channels 13, 15 outward at a thirty degree angle again for a distance of twenty percent of the overall length of the flow channel 12. These two seepage flares 17, 19 together provide an extended path and reduce the hydrostatic pressures against the levee wall 6 at the point of the cut 9. It is important that the flare be provided at both the inlet and the outlet because, as shown in FIG. 3, in usual operation there is both an upper pond level 7 and a lower pond level 8 and therefore hydrostatic pressure is imposed against both the inlet and the outlet of the penstock.

In addition, I provide a seepage interrupter plate 21 extending perpendicularly from the outer surface of the left and right side flow channels 13, 15 continuously around and out perpendicularly from the outer surface of the base plate 11 and extending a substantial distance beyond the outer dimensions of the. When the overall penstock 1 is embedded in the levee walls 6, the seepage interrupter plate 21, being tamped substantially into the earth of the levee wall 6, breaks up all seepage flow which would otherwise attempt to migrate along the interface between the outer surface of the side flow channels 13 and 15 and the base plate 11 and the earth of the levee 3 along the edges of the levee cut 9.

I also provide, for reasons as hereinafter described, an upper interrupter plate cross arm 23 providing a continuous member across the upper edge of the penstock 1 perpendicular to the directional flow through the flow channel 12. This interrupter plate cross arm provides strength against deformation from hydrostatic and moving earth forces for the left and right side flow channels 13 and 15 and also provides an attaching point for an alternate flow control plate location means as will be hereinafter described.

Within the flow channel 12 the flow of water from the upper pond level 7 to the lower pond level 8 is controlled by the presence of a variable flow control plate 25 which sealingly fills the flow channel 12 formed by the base plate 11 and the vertical side walls of the side flow channel 13 and the side flow channel 15. This flow control plate 25 is hinged at its bottom by flow control plate hinge 27 mating with a flow control plate hinge socket 29 installed at the base of the base plate 11 in a manner so as to provide essentially a smooth arcing pivot point for the flow control plate 25. The flow control plate 25 may be moved in a smooth arc between two extreme positions.

The first is an essentially flat position, parallel to the base plate 11, whereby the flow control plate provides essentially no resistance to the flow of liquid through the flow channel 12 causing the fluid levels of the upper pond level 7 and the lower level 8 to attempt to become equal.

Figure 4:
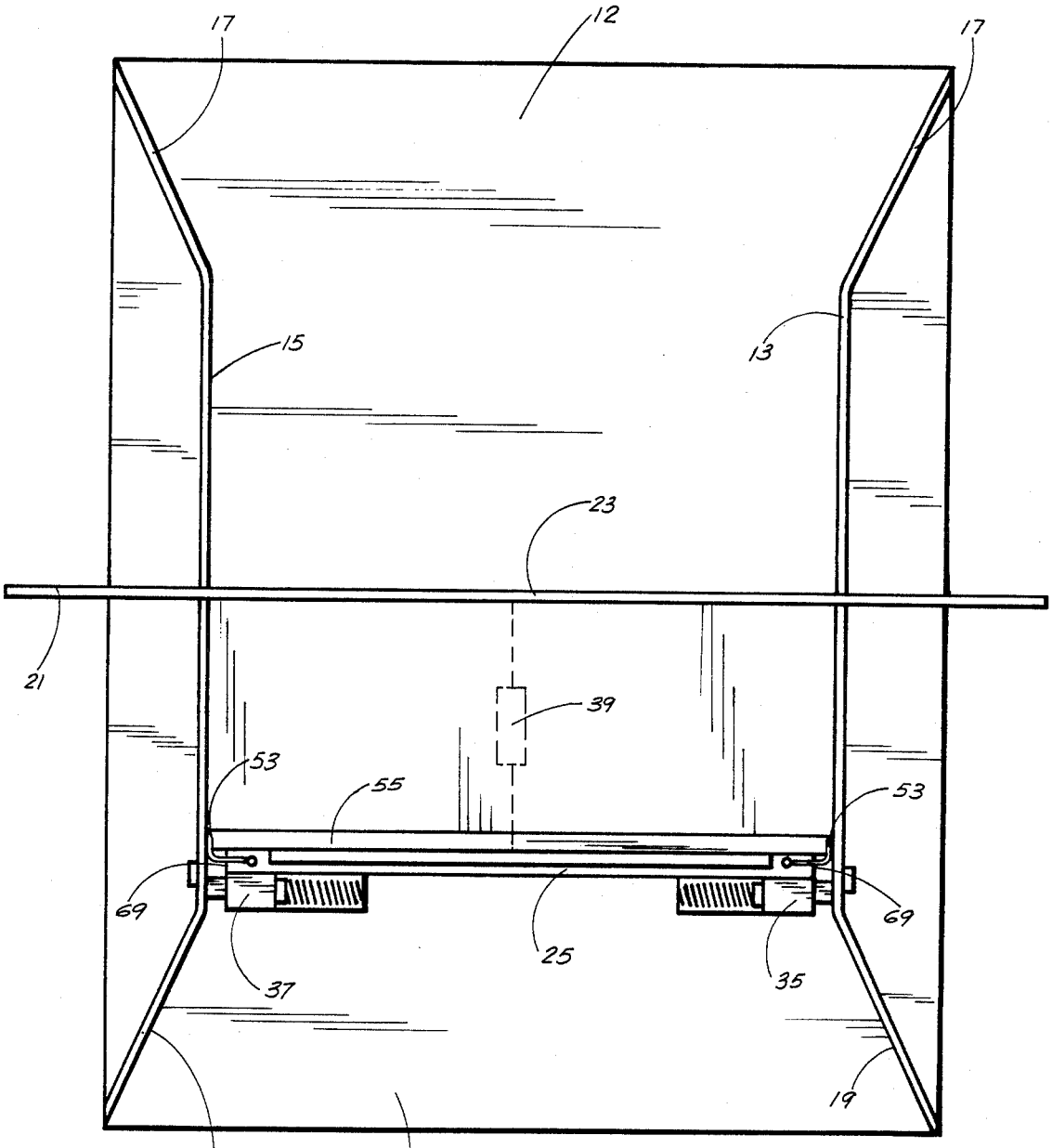
FIG. 4 is a top view of the improved penstock with the flow control plate in its maximum or highest position.

At the other extreme, flow control plate 25 is pivoted along the flow control plate hinge 27 until it is substantially vertical. At this point the flow control plate, shown in FIG. 4, is blocking substantially all of the flow channel 12 forming thereby a blockage to liquid flow approximately two inches lower than that provided by the uncut levee wall 6 to avoid overflow over the levee wall 6, and retaining liquid within the upper pond level 7 as though no penstock were installed and the levee wall were continuous.

As shown in FIG. 3 the levels between the upper pond level 7 and the lower pond level 8 can be continuously varied by pivoting the flow control plate 25 to any of a plurality of positions or arcs between its lowest and its most uppermost vertical possible state.

The flow control plate 25 is called upon to resist substantially all the hydrostatic pressure due to the difference in liquid level between the upper pond level 7 and the lower pond level 8. There are provided substantial position locking means 35, 37 for holding the flow control plate 25 at any of its possible positions. These locking means in the preferred embodiment include a left side locking arc 31 and a right locking arc 33, which arcs are embedded within their matching side flow channels 13, 15 at a position adapted to the arc circumscribed by the left side lock 35 and the right side lock 37 which are respectively located at the upper left and upper right edges of the flow control plate 25 at the ends opposite from the flow control plate hinge 27. Each of the left side lock 35 and the right side lock 37 in turn are comprised of a substantially strong side locking bolt 35 installed slidingly within an enclosing side locking bolt chamber 47 which is itself attached permanently to the downstream side of the flow control plate 25 at each of the upper corners of the flow control plate. Within the side locking bolt chamber 47 is provided a side locking bolt spring 49 which is a compression spring engaged and retained by a pair of side locking bolts spring pins 50 located on the inner end of the side locking bolt 45 and on the inner opposite wall of the side locking bolt chamber 47. The side locking bolt spring 49 is a compression spring tending to force the side locking bolt 45 outward along its longitudinal axis. Side locking bolt 45 is also provided with a side locking bolt handle 51 enabling it to be moved longitudinally against the force of the spring 49 so as to withdraw it into the chamber 47. The ends of the side locking bolt are provided with side locking bolt teeth 57 comprising a plurality of repeating teeth angled to and adaptably matching a series of side locking arc teeth embedded within the left and right side locking arcs 31 and 33.

A plurality of such teeth 57 and mating side locking arc teeth 59 distributes the forces transmitted by the hydrostatic force of the water upon the flow control plate 25, thence through the side locking bolt chamber 47 to the side locking bolt 45, thence and by means of the intermeshing multiple teeth 57 and the side locking arc teeth 59, into the side locking arc 31, 33 whereby the forces are resisted by the overall strength of the left and right side flow channels 13 and 15. This provides a sufficiently strong and suitably rigid structure so that it is able to resist the flow forces of the water at all positions of the flow control plate without jamming or breaking.

The multiple interrupted tooth structure described above is most suitable when the overall penstock 1 is made out of a reinforced plastic material such as fiberglass or any one of substantially strong structural thermo-setting plastics. The strength of these materials is such, and the combination of their ductility and fracture resistance is such, that the multiple interrupted tooth structure properly distributes the loads and at the same time the multiple interrupted tooth structure can be readily obtained due to the ability of molding processes for the production of the left and right side locking arcs 31 and 33 and the teeth and bolt on the side locking bolts 45.

As will be obvious to those skilled in the art, providing a locking mechanism which penetrates completely through the side flow channels 13 and 15 would defect the seepage preventation methods which have been described and would allow the seepage and erosion of bypass channels past penstock 1.

Any penetration completely through the side flow channels 13 and 15 would permit the passage of water outside the flow channel 12 and lead to seepage erosion and ultimate failure of the penstock 11 within the levees cut 9. Where penstock 1 is made of metal, such as a mild corrosionresistant steel or aluminum, the stresses and strengths of the materials are such that, while the multiple tooth structure 57, 59 can be used, it is more feasible to provide side locking bolts of a standard solid bolt structure and to provide that the left and right side locking arcs 31 and 33 are comprised of a multiplicity of extending mating lugs or alternately receiving holes adapted to the arc cut by the swing of the left and right side locks 35 and 37, and, for the holes, to place behind these holes on the outside of the side flow channel plates 13 and 15 a backing plate (not shown) which can be readily welded into place. This will prevent the seepage flows and subsequent failures described above and, from the manufacturing point of view, this is an acceptable alternative when metal is used to make the penstocks 1. As a third positioning means, the seepage interruptor plate 25 is extended across the top of the flow channel 12, forming an upper interruptor plate cross arm 23. Any of a number of variable plate positioning means 39, such as a turnbuckle or block and tackle, all well known in the art, may be fastened between the cross arm 23 and the plate 25, for positioning and supporting plate 25.

Figure 5:
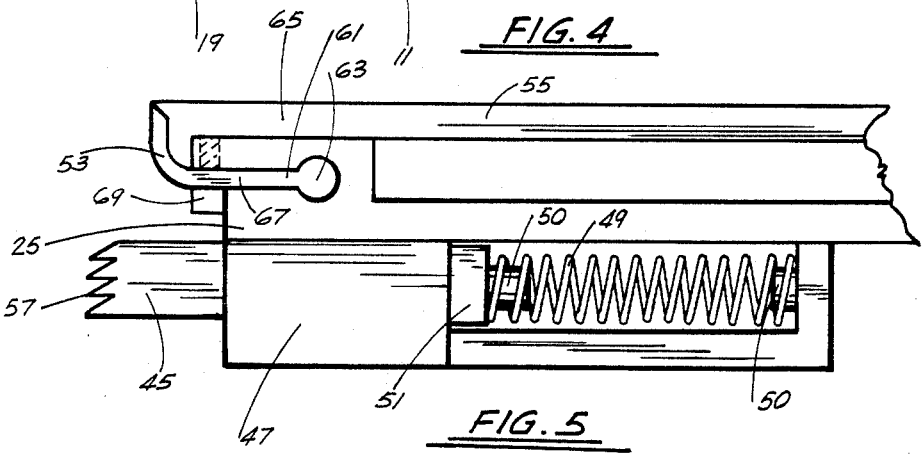
FIG. 5 is a detailed sectional view of one of the side locking bolts of the flow control plate.

This invention provides a mechanism having a flow control plate 25 which, distinguishably from the prior art vertical gate penstock mechanisms, always provides for the retention of a minimum liquid level below the level of its upper edge. One of the principal objects of this invention is the safe retainage of a certain upper pond level 7 determined by the position along the left and right side locking arcs 31 and 33 of the flow control plate 25. The improved penstock also provides a sweeping side liquid sealing means shown more specifically in FIG. 5, as side liquid seal 53, and a similar flow control plate base seal 55 which are installed as hereinafter described. The side liquid seal 53 is typical; it is embedded in a continuous side channel 61 which has an anchoring base 63, and extends substantially out from the edge of the flow control plate 25 as a continuous strip seal 65 extending along the outer edge of the control plate 25, from its upper edge adjacent to the left and right side locks 35 and 37, extending down to the position of the flow control plate hinge 27, thence continuously along the base of the flow control plate 25, comprising there the flow control base seal 55, and thence up an identical structure on the opposite edge of the flow control plate 25.

This continuous strip seal 65 extends out from the edge of plate 25 and is folded over by the contact between the edge of the flow control plate 25 and the adjacent side flow channel 13 or 15. The edge of the flow control plate 25 is provided with a reinforcing lip 65, which exends measurably beyond the normal edge level 69, and thus supports the continuous support strip seal 65 against the side flow channels 13 and 15 with sufficient force to provide a liquid-tight seal, yet without creating a metal-to-metal or plastic-to-plastic interference of such tight tolerance that the flow control plate 25 could not be readily moved.

This sealing arrangement as above described is sufficient to prevent seepage past the flow control plate at all position of the flow control plate, from vertical to horizontal, and the penstock as described thus maintains a complete, liquid-tight separation between the upper pond level 7 and the lower pond level 8, such separation being determined solely by the arcuate positioning of the flow control plate 25.

This description has been of a preferred embodiment of the invention and should not be taken to restrict this description to the particular positioning means described but rather this is typical of a number of similar methods for positioning the flow control plate along its arc and the invention is rather all similial structures as hereinafter claimed.

What is claimed is:

1. An improved penstock for obtaining and maintaining a differential level of liquid between two adjacent bodies of the liquid separated by a levee, wherein said improved penstock comprises:

(a) a flow channel means within the wall of said levee allowing liquid flow from an upper to a lower level, comprising:
  (1) an essentially flat lower base plate;
  (2) two substantially vertical parallel flow channel walls attached to the base plate, restricting the flow of liquid to the channel formed by the base plate and the flow channel walls;

(b) an essentially rectangular flow control plate adaptably sized to fill the flow channel created by the base plate and the flow channel walls, wherein said rectangular flow control plate further comprises:
  (1) a base hinging means for hinging and pivoting the rectangular plate along an axis on the base plate perpendicular to the direction of the flow of the liquid through the flow channel;
  (2) a positional locking means for pivotally positioning the flow control plate along a plurality of positions between a horizontal and vertical position, wherein said flow control plate provisional locking means further comprises:
    (i) a pair of bolts, each extending outward, to the flow channel walls, from upper corners of the pivoting flow control plate; a pair of housings to slidably receive, at least in part, the pair of bolts, the housings being fixedly attached to corresponding upper corners of the flow control plate and a compression spring means for forcing the bolt engagingly outward from the flow control plate against the side walls of the flow channels;
    (ii) a radially swept arc embedded in the flow channel wall, wherein said arc provides: a repeated embedded pattern of a multiplicity of teeth sizingly corresponding to the teeth on the bolt, wherein said radially swept arc corresponds to each position of the flow control plate between its horizontal and vertical position;
  (3) a sealing means for sealing the sides and bottom of the flow control plate against the fluid flow.

2. The improved penstock as described in claim 1, wherein the penstock further comprises:

(a) a seepage control means, for preventing a flow of liquid around the exterior of the penstock and preventing the flow past the flow control plate of the penstock.

3. The improved penstock as described in claim 2, wherein said seepage control means further comprises:

(a) flared side walls of the flow channel at both inlet and outlet ends;

(b) a continuous plate extending perpendicular to the flow channel sides and bottom, extending substantially into the levee walls beyond the outer dimensions of the flow channel.

4. The improved penstock as described in claim 1, wherein said flow control plate sealing means comprises:

(a) an extruded rubber seal, clampingly anchored within the outer edges of the flow control plate extending the length of the side and bottom edges of the flow plate wherein said rubber said rubber seal meets the channel wall at an angle;

(b) an extended outer lip along the edges of the control plate, wipingly pressingly said seal against the flow channel walls and bottom.

5. An improved penstock for obtaining and maintaining a differential level of liquid between two adjacent bodies of the liquid separated by a levee, wherein said improved penstock comprises:

(a) a flow channel means within the wall of said levee allowing liquid flow from an upper to a lower level, comprising:

(1) an essentially flat lower base plate;

(2) two substantially vertical parallel flow channel walls attached to the base plate, restricting the flow of liquid to the channel formed by the base plate and the flow channel walls;

(b) an essentially rectangular flow control plate adaptably sized to fill the flow channel created by the base plate and the flow channel walls wherein said rectangular flow control plate further comprises:

(1) a base hinging means for hinging and pivoting the rectangular plate along an axis on the base plate perpendicular to the direction of the flow of the liquid through the flow channel;

(2) a positional locking means for pivotally positioning the plate along a plurality of positions, between a horizontal and vertical position, wherein said flow control plate positional locking means further comprises:

i. a pair of bolts, each extending outward, to the flow channel walls, from upper corners of the pivoting flow control plate, a pair of housings to slidably receive, at least in part, the pair of bolts, the housings being fixedly attached to corresponding upper corners of the flow control plate and a compression spring means for forcing the bolt engagingly outward from the flow control plate against the side walls of the flow channels;

ii. a radially swept arc on the side walls of the flow channels correspondingly positioned opposite said bolt and along a path said bolt moves as the flow control plate pivots along an axis on the base plate perpendicular to the direction of the flow of liquid through the flow channel, wherein said arc further comprises: (1) a multiplicity of sealed non-penetrating bolt receiving holes;

(3) a sealing means for sealing the sides and bottom of the flow control plate against the fluid flow.

* * * * *